United States Patent [19]

Takasu et al.

[11] Patent Number: 4,471,694

[45] Date of Patent: Sep. 18, 1984

[54] PRINTING PROCESS FOR TRANSFERRING FIXED IMAGE FROM MASTER

[75] Inventors: Yoshio Takasu, Tama; Tadaji Fukuda, Kawasaki; Junichiro Kanbe, Yokohama, all of Japan

[73] Assignee: Canon Kabushiki Kaisha, Tokyo, Japan

[21] Appl. No.: 521,637

[22] Filed: Aug. 10, 1983

Related U.S. Application Data

[63] Continuation of Ser. No. 300,582, Sep. 9, 1981, abandoned.

[30] Foreign Application Priority Data

Sep. 18, 1980 [JP] Japan ..... 55-130238

[51] Int. Cl.[3] ..... G03G 5/082

[52] U.S. Cl. ..... 101/211; 101/DIG. 13; 101/426; 355/3 TR; 430/33

[58] Field of Search ..... 101/426, 471, 450.1, 101/463.1, 466, DIG. 13, 211; 355/3 TR, 3 TE, 4; 430/33, 48

[56] References Cited

U.S. PATENT DOCUMENTS

| | | | |
|---|---|---|---|
| 3,352,731 | 11/1967 | Schwertz et al. | 101/471 |
| 3,678,852 | 7/1972 | Feinleib et al. | 101/450.1 |
| 3,752,076 | 8/1973 | Kaminstein | 101/471 |
| 3,862,848 | 1/1975 | Marley | 101/466 X |
| 3,921,527 | 11/1975 | Raschke et al. | 101/463 |
| 3,955,530 | 5/1976 | Knechtel | 355/3 TR |
| 3,976,485 | 8/1976 | Groner | 355/4 |
| 4,057,016 | 11/1977 | Endo et al. | 61/465 |
| 4,068,938 | 1/1978 | Robertson | 355/4 |
| 4,069,759 | 1/1978 | Endo et al. | 101/467 |
| 4,080,897 | 3/1978 | Gundlach | 101/471 |
| 4,115,602 | 9/1978 | Bullard | 101/426 X |
| 4,171,157 | 10/1979 | Suzuki | 355/3 TR |
| 4,225,222 | 9/1980 | Kempter | 355/3 DR |
| 4,226,898 | 10/1980 | Ovshinsky | 427/39 |
| 4,265,991 | 5/1981 | Hirai et al. | 430/64 |

FOREIGN PATENT DOCUMENTS

| | | | |
|---|---|---|---|
| 1332702 | 10/1973 | United Kingdom | 101/471 |

*Primary Examiner*—E. H. Eickholt

*Attorney, Agent, or Firm*—Fitzpatrick, Cella, Harper & Scinto

[57] ABSTRACT

A printing process comprise formation of fixed toner images on a photoconductive substrate by using an electrophotographic method, selective application of color materials onto the image portions of the fixed toner images, and printing of said color material applied onto the fixed toner image to a transfer sheet characterized by removing said fixed toner images from the used photoconductive substrate, forming other toner images on the photoconductive substrate thus reclaimed by using an electrophotographic method, application of color materials onto said other toner images, and printing of said color material applied onto the other fixed toner image to a transfer sheet.

5 Claims, 8 Drawing Figures

PRINTING PROCESS FOR TRANSFERRING FIXED IMAGE FROM MASTER

This application is a continuation of application Ser. No. 300,582 filed Sept. 9, 1981, now abandoned.

BACKGROUND OF THE INVENTION

1. Field of the Invention

The present invention relates to a printing process comprising formation of a printing plate using an electrophotographic technique, conducting printing using the printing plate, and reusing the used printing plate.

2. Description of the Prior Art

Preparation of an original plate to be used for printing has been conducted by a process such as chemical processes including methods using photosensitive resins, which comprises printing of a photoimage on a photosensitive resin film applied onto a substrate, and removing the photosensitive resin of either image portions or non-image portions by using a difference of solubility of the resin between image and non-image portions, and methods for forming metallic images by using silver halides, and a process by means of an electrophotographic technique such as direct formation of a toner image on a photoconductive substrate of zinc oxide and indirect formation of a toner image on a substrate for transfer. As a printing process using a prepared printing plate, there may be mentioned methods such as a method which comprises selective adhesion of inks by using a difference of surface energy between image and non-image portions and, if necessary, conducting print on a transfer sheet through a blanket or a roller for offset printing, and another method which comprises electrostatic adhesion of a toner by using difference of electric resistance between image and non-image portions and transfer of the obtained toner image to another sheet.

However, used printing plates of these conventional methods are scrapped without reuse whereas in the present invention used printing, original plates are reclaimed.

SUMMARY OF THE INVENTION

It is an object of the present invention to provide a printing process capable of reclaiming and reusing used printing original plate.

It is another object of the present invention to provide a printing process capable of reducing printing cost by reclamation and reuse of used printing original plate.

It is a further object of the present invention to provide a printing process capable of printing a different original image speedily by means of reclamation and reuse of used printing original plate.

According to the present invention, there is provided a printing process comprising formation of fixed toner images on a photoconductive substrate by using an electrophotographic method, selective application of color materials onto the image portions of the fixed toner images, and printing of said color material applied onto the fixed toner image to a transfer sheet characterized by removing said fixed toner images from the used photoconductive substrate, forming other toner images on the photoconductive substrate thus reclaimed by using an electrophotographic method, application of color materials onto said other toner images, and printing of said color material applied onto the other fixed toner image to a transfer sheet.

Since used printing original plates can be reused in the present invention, it is possible to reduce printing cost and to speedily conduct printing.

BRIEF DESCRIPTION OF THE DRAWING

FIG. 1 shows a charging step,
FIG. 2 a projection step of photoimage pattern,
FIG. 3 a developing step,
FIG. 4 a fixing step,
FIG. 5 a charging step for charging toner images,
FIG. 6 a color material applying step,
FIG. 7 a color material transferring step, and
FIG. 8 a removing step of an insulating thin film.

DESCRIPTION OF THE PREFERRED EMBODIMENTS

Photoconductive materials excellent in durability are used for a photoconductive substrate of a printing original plate to be used in the present invention. Particularly, there is preferably used one comprising a photoconductive layer of amorphous silicon formed on a metallic base plate, for example, one prepared by following various processes described in the specification of Japanese Patent Laid-Open No. 86341/1979.

The following procedure is a typical embodiment of the printing process according to the present invention. Images of an insulating toner are formed on a photoconductive substrate by using a conventional electrophotographic technique, and the obtained toner images are fixed on the photoconductive substrate by heating and fusion to obtain a printing original plate. The obtained printing original plate is subjected to corona-charge, if necessary, subsequent to exposure so that portions having no toner image can not be charged and portions having toner images can be charged. Then, the portions having toner image are developed by using a developing means of a conventional electrophotographic technique.

Printed images can be obtained by electrostatically transferring the developed images onto a transfer sheet, such as paper, film, and the like, and fixing same thereon. The desired number of printed sheets can be obtained by repeating the above-mentioned electrostatic printing steps.

Next, the fixed toner images are removed from the printing original plate, where printing is completed, for reuse of the plate. The removing step can be carried out, for example, by removing the fixed toner image by using a blade having a hardness harder than that of the fixed toner. Additionally, it is very effective that the fixed toner image is previously softened by heat or solvents. While the photoconductive substrate reclaimed by the above-mentioned procedure has been exposed to treatments such as heating for fixing a toner, mechanical load for removing a fixed toner image, and the like, the reclaimed photoconductive substrate can be reused for a printing plate as described in the Example. In other words, no charge is observed in charge bearing and photoconductive characteristics, therefore toner images can be formed on the reclaimed plate and fixed so that the obtained printing original plate can be used as a printing original plate.

The attached drawings are illustrations explaining preparing and reclaiming steps of a printing original plate according to the present invention.

Figure 1:
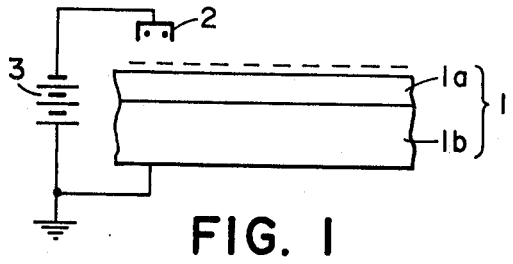
FIGS. 1 through 8 show an embodiment of the present invention.
Figure 2:
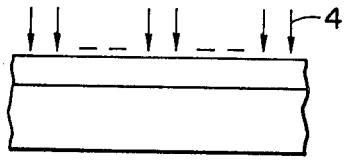
Figure 3:
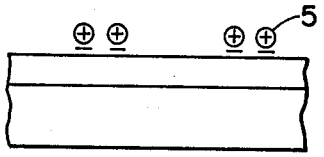

Steps shown in FIGS. 1 through 4 are carried out by well known methods at steps for electrophotographically preparing a printing original plate. FIG. 1 shows a charging step on surface of a photoconductive substrate. A photoconductive substrate 1 is constituted of an amorphous silicon layer 1*a* formed on surface of a metallic base plate 1*b*. The photoconductive substrate is charged at a dark place by using a corona-charging device 2 and a high frequency power source 3. Then, as shown in FIG. 2, the photoconductive substrate is exposed to a photoimage pattern 4 so that surface charge of the exposed portions is erased to obtain an electrostatic charge pattern. Further, as shown in FIG. 3, a developing treatment is carried out and an insulating toner 5 is allowed to adhere on the photoconductive substrate 1 by the electrostatic attraction to obtain toner images. Development is carried out by a known technique such as two-component magnetic brush development, cascade development, one-component magnetic development, wet development, and the like.

Figure 4:
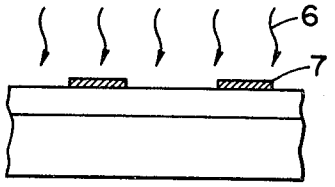

Finally, as shown in FIG. 4, the obtained toner image is exposed to heat radiation and fixed as an insulating thin layer 7 by fusion of the toner. Fixing is carried out by heat radiation, but can also be carried out by heat transmission such as heat-roller, or exposure to vapor of solvents capable of dissolving the toner.

Figure 5:
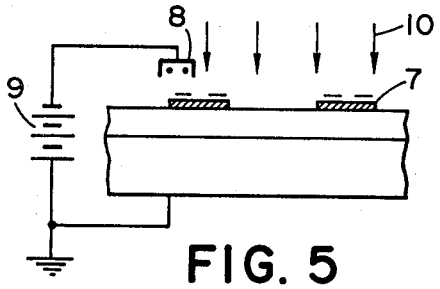
Figure 6:
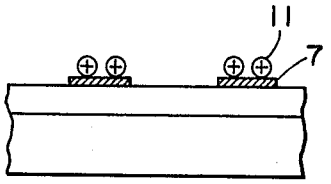
Figure 7:
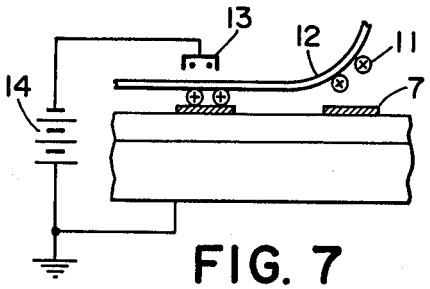

The required number of printed matter is carried out by repeating the printing steps shown in FIGS. 5 through 7 using the previously prepared printing original plate. FIGS. 5 through 7 show a typical electrostatic printing process. In FIG. 5, corona-charge is effected to a printing original plate prepared in the previous steps by using a charging device 8 attached to a high frequency power source 9. Subsequently, a light 10 having wave length to which the photoconductive substrate is sensitive, is projected on the whole surface of the substrate. Therefore, charge is hold only on a region of an insulating thin layer 7 where the insulating toner is fixed.

Next, in FIG. 6, development is carried out and a color material 11 is applied onto the insulating thin layer 7.

Further, as shown in FIG. 7, the color material 11 is transferred onto a transfer sheet 12 to obtain a printed sheet. In the case of FIG. 7, electrostatic transfer is carried out under the conditions that a corona-charging device attached to a high frequency power source 14 is positioned on the backside of the transfer sheet. Of course, other methods can be used.

Figure 8:
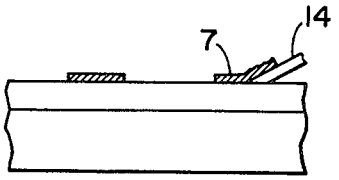

Steps shown in FIGS. 5 through 7 are repeated according to the required number of printed sheets. FIG. 8 shows an embodiment of the step for reclamation of an used photoconductive substrate. A used printing original plate is reclaimed by mechanically removing the fixed toner image and the color material from the photoconductive substrate by using a knife-blade having a hardness higher than that of the toner material. The reclaimed photoconductive substrate can be used for preparing a printing original plate by the steps shown in FIGS. 1 through 4.

Additionally, it is effective for making the removal of the insulating thin layer 7 easy and for lowering hardness of a blade to be used that the insulating thin layer 7 is previously softened by heat or solvents. Further, it is also a preferably embodiment of the reclaiming step according to the present invention that a residual toner layer on the surface of the photoconductive substrate after removal is additionally cleaned by using waste, etc.

Printing steps shown in FIGS. 5 through 7 exemplify a process with respect to an electrostatic printing, however there may be used other usual processes such as offset printing, fluid duplicating process, and the like.

For example, dampening water is supplied to non-image portions having no toner image by using a damping roller, ink is attached onto image portions by using an ink roller, and printing is carried out on a transfer sheet through a blanket roller. In the case of a fluid depletion, a toner containing soluble dyestuff is used. Toner images formed by the toner are wetted by a solvent for the dyestuff (for example, ethanol), and the solved dyestuff can be printed onto a transfer sheet. In any printing process, a used photoconductive substrate can be reclaimed by removing a residual toner layer by a hydrophilicizing agent, which is used in an offset printing process for making hydrophilic non-image portions so that ink can not attach to non-image portions, and the like with using helpfully solvents and/or heating, if necessary.

As mentioned above, according to the printing process of the present invention, the same one photoconductive substrate can be repeatedly used as a printing original plate. Therefore, it is not required in the present process that a used printing original plate is changed and therefore that a hand is stained by scrapping a used printing original plate. There is such a problem in the conventional processes. Also a step for preparing printing original plate can be automatically conducted, since the step is conducted by electrophotographic means in the present invention.

Accordingly, in the case of the printing process according to the present invention, it is possible to manufacture an automatic printing equipment in which a preparation step of an original printing plate, a printing step, and a reclaiming step are unified.

EXAMPLE

An aluminum cylinder having a polished surface was used as a substrate to be deposited. $SiH_4$ gas was introduced into a deposition chamber, and high frequency electric field was applied to discharge electrodes to generate plasma in the deposition chamber, and then $SiH_4$ was decomposed by plasma energy to deposit an amorphous silicon thin film in the thickness of 20 microns on the cylinder.

Charge was carried out by corona applied voltage of −6 KV on the resulting photoconductive substrate in a dark place to obtain voltage of −430 V. Then a photoimage was projected by 20 lux. in illuminance on an exposure surface for 0.2 sec., a magnetic brush development was carried out by using a developer composed of carrier iron powder and toner powder containing stylene-acrylic resin and carbon black as principal constituents to otain clear and sharp images free from fog. The resulting images were fixed on the surface of the amorphous silicon thin film to prepare a printing original plate.

Two plates were prepared in the same manner. One of them was used for electrostatic printing. Another was treated by using a commercial hydrophilicizing agent for offset using zinc oxide, which contains dilute aqueous solution of polyvinylalcohol, to use for offset printing.

Using each plate, one hundred of plane paper were printed by electrostatic printing and offset printing to obtain excellent images. Next, while the used electrostatic printing original plate was heated at 70° C., a leaf spring of phosphor bronze was pressed onto the rolling plate to remove the fixed toner. The other hand, after the used printing original plate for offset was wetted by a mixture of water and alcohol, materials attaching on the surface of the plate were mechanically scraped off by using a blade of phosphor bronze in a similar way to that in the case of the electrostatic printing original plate to reclaim the used photoconductive plate.

Using each reclaimed photoconductive substrate, a cycle comprising the above-mentioned preparation step of an original printing plate, a printing step, and a reclaiming step was repeated. Table 1 shows results with respect to numbers of repeated cycles, change of photoconductivity, and quality of printed images.

TABLE 1

| | | Initial | 10 cycles | 100 cycles | 1000 cycles |
|---|---|---|---|---|---|
| Electrostatic printing | Surface potential | 430 V | 440 V | 430 V | 430 V |
| | Sensitivity (1) | 2.2 lux · sec. | 2.1 lux · sec. | 2.2 lux · sec. | 2.1 lux · sec. |
| | Quality of image (2) | | no change | no change | no change |
| Offset printing | Surface potential | 435 V | 420 V | 440 V | 430 V |
| | Sensitivity (1) | 2.2 lux · sec. | 2.2 lux · sec. | 2.1 lux · sec. | 2.2 lux · sec. |
| | Quality of image (2) | | no change | no change | no change |

(1) Sensitivity is represented a quantity of light required for decreasing a surface potential of a photoconductive substrate to 1/10.
(2) Quality of image obtained is judged in comparison with that of the image in the initial cycle.

For comparison, each photoconductive substrate of selenium and zinc oxide was also used. However, in both cases, the photoconductive substrates lose the sensitivity and are remarkably subjected to mechanical damage during reclamation. Therefore these substrates can be used only in one cycle.

What we claim is:

1. A printing process comprising (a) electrophotographically forming fixed toner images on a photoconductive substrate having amorphous silicon as a matrix (b) selectively applying color material onto the image portions of the fixed toner images (c) printing said color material applied onto the fixed toner images to at least one transfer sheet, and (d) removing the fixed toner images from the used photoconductive substrate thereby reclaiming the photoconductive substrate.

2. A printing process according to claim 1, wherein fixed toner images are formed by heat fixation.

3. A printing process according to claim 1, wherein the fixed toner images are removed by using a blade having a hardness higher than that of the fixed toner.

4. The process of claim 1 including repeating steps (a), (b), and (c) after step (d).

5. The process claim 4 including repeating steps (a) through (d).

* * * * *